United States Patent [19]

Kent

[11] Patent Number: 4,765,355

[45] Date of Patent: Aug. 23, 1988

[54] WHEELED WALKING DEVICE

[76] Inventor: Charles C. Kent, 2409 Waneta Dr., Sarasota, Fla. 33581

[21] Appl. No.: 912,354

[22] Filed: Sep. 26, 1986

[51] Int. Cl.[4] ..... A61H 3/00

[52] U.S. Cl. ..... 135/67; 272/70; 297/5

[58] Field of Search ..... 5/83, 86; 16/18 R, 45, 16/35 R; 70/225; 135/67; 188/1.12, 19, 69; 272/70.3, 70.4; 280/7.1, 87.1, 87.2, 47.26; 297/5, DIG. 4; 305/9

[56] References Cited

U.S. PATENT DOCUMENTS

| | | | |
|---|---|---|---|
| 1,729,557 | 9/1929 | Stoll | 135/67 |
| 1,917,440 | 7/1933 | Finkbeiner et al. | 135/67 |
| 1,949,163 | 2/1934 | Kasten et al. | 297/5 |
| 2,077,569 | 4/1937 | Kish | 135/67 |
| 2,244,869 | 6/1941 | Everest et al. | 135/67 |
| 2,792,052 | 5/1957 | Johannesen | 135/67 |
| 3,276,550 | 10/1966 | Honeyman | 188/19 |
| 4,018,440 | 4/1977 | Deutsch | 272/70.3 |
| 4,029,311 | 6/1977 | Chanslor et al. | 272/70.3 |
| 4,086,932 | 5/1978 | Richardson | 135/67 |
| 4,159,110 | 6/1979 | Dodenhoff | 135/67 |
| 4,211,309 | 7/1980 | Ruggiero | 272/70.3 |
| 4,251,105 | 2/1981 | Barker | 135/67 |
| 4,341,381 | 7/1982 | Norberg | 135/67 |
| 4,384,713 | 5/1983 | Deutsch et al. | 135/67 |
| 4,461,471 | 7/1984 | Brastow | 272/70.3 |
| 4,510,956 | 4/1985 | King | 135/67 |

FOREIGN PATENT DOCUMENTS 485819 11/1917 France .

*Primary Examiner*—Robert A. Hafer
*Assistant Examiner*—Charles H. Sam
*Attorney, Agent, or Firm*—Frijouf, Rust & Pyle

[57] ABSTRACT

A wheeled walking device is disclosed with a carriage frame having a first and second side bar. Each of the side bars includes a proximal and distal end with a transverse bar connecting the side bars in a torsionally rigid manner. A plurality of ground engaging wheels stably support the carriage frame. A first and second post each include a first and second end with the second ends of the first and second post securely mounted at each proximal end of each first and second side bar respectively. Each first and second post extends upwardly from the carriage frame relative the ground. A first crossbar is securely attached to each first end of the first and second post to interconnect the first post with the second post and to provide for an arm rest surface. The plurality of wheels includes a first and second wheel rotatably mounted at the second ends of the first and second posts, respectively. The proximal ends of each of the first and second side bars further include a downwardly and rearwardly extending portion to stop the device when the walker device is pivoted back enabling the downwardly and rearwardly extending portions to frictionally engage the ground thereby preventing the walker device from moving. A means for directly restraining rotation of at least one of the plurality of wheels further enables a person to walk, slow down or stop without any need for other assistance.

7 Claims, 4 Drawing Sheets

WHEELED WALKING DEVICE

BACKGROUND OF THE INVENTION

1. Field of the Invention

This invention relates to a wheeled walking device and more specifically, to a stable walking device without feet entangling structure adjacent the sides of the user.

2. Information Disclosure Statement

A multitude of prior art devices which aid one who is impaired in his ability to walk are widely known. These devices are wheeled and move about the surface of the ground, or are non-wheeled and frictionally engage the ground, or are a combination thereof. The devices operate by allowing the user to transfer his weight to the device thereby enabling the legs of the user to be easily moved about. The combination devices utilize both a wheel and a frictionally engaging portion to enable the user to move the device along the ground while holding the ground engaging portion above the ground. When the user desires to stop he merely places the ground engaging portion on the ground to provide a stable stopped position.

One prior art devices utilizes a U-shaped walker where the user is "wrapped" on three sides by one forward and two side members. The lower portion of the walker is fitted with four wheels with the front being fitted with a brake means. The walker is foldable.

Another four-wheeled walker utilizes a shoulder support post and hand grips in order to provide the user with four points for transferring his weight to the walker. This device also "wraps" three sides of the user.

In another prior art device, brakes or wheel retarding mechanisms are provided for each individual wheel. In the use of this device each wheel is individually adjusted in order to enable the user to move about while the wheel retarding mechanism is in constant engagement.

Another folding wheeled apparatus utilizes a front caster wheel with two trailing wheels. While not being provided with a braking means, the device is foldable for easy storage.

In another prior art walker apparatus, a U-shaped frame is provided with four vertical members, the lower ends of which carry casters. The trailing wheels each carry a braking means which is activated by handles at the upper end of the walker device.

In another walker device, the U-shaped frame is provided with a leading wheel which is breakable by a downward pressure thereby inhibiting movement.

Other walking devices include a single means for transferring the weight of the user to the apparatus. Such devices include a glider cane and a wheel supported crutch.

The problems of the prior art devices include a structure which has feet entangling portions located to either side of the user which inhibit the movement of the user and which may trip the user. Further, the prior art devices fail to provide an alternative brake means to stabilize the apparatus and the user when the user tilts the device in a rearward manner.

It is a primary object of this invention to provide a wheeled walker device which enables the user to move about without regard to a laterally placed foot-entangling structure.

It is a further object of this invention to provide a wheeled walker device which is simple in design and easy to operate.

It is further object of this invention to provide a wheeled walker device which provides a braking action when the user tilts the device in a rearward manner.

It is a further object of this invention to provide a wheeled walker device which carries the weight of the user while allowing the user to use his feet to propel himself.

It is a further object of this invention provide a wheeled walker device which provides a stable stopped and braked position without the need for constantly gripping a brake activating structure.

It is a further object of this invention to provide a wheeled walker which is easy to steer, easy to stop and easy to maintain in a stationary position.

It is a further object of this invention to provide a wheeled walking aid which is easily collapsible thereby facilitating its storage and transportation.

The foregoing has outlined some of the more pertinent objects of the present invention. These objects should be construed to be merely illustrative of some of the more pertinent features and applications of the invention. Many other beneficial results can be obtained by applying the disclosed invention in a different manner or modifying the invention within the scope of the disclosure. Accordingly, other objects and a fuller understanding of the invention may be had by referring to the summary of the invention and the detailed description describing the preferred embodiment in addition to the scope of the invention defined by the claims taken in conjunction with the accompanying drawings.

SUMMARY OF THE INVENTION

The wheeled walking device of the present invention is defined by the appended claims with specific embodiments shown in the attached drawings. For the purpose of summarizing the invention, the invention relates to a wheeled walking device for persons unable to walk without assistance. The wheeled walking device includes a carriage frame with a first and second side bar positioned in a parallel and spaced apart manner with a transverse bar interconnecting the first and second side bar in a torsionally rigid manner. The first and second side bars of the carriage frame each include a proximal and distal end. First and second posts are positioned in a parallel and spaced relationship and each includes a first and second end such that the second ends of the first and second posts are is mounted at each proximal end of the first and second side bars, respectively. Each of the first and second posts extends vertically relative the carriage frame. A first crossbar securely attaches the first end of each first and second post thereby interconnecting the first and second post and providing for an arm rest surface. A plurality of ground engaging wheels stably support the carriage frame. The plurality of wheels includes a first and second wheel rotatably mounted at the second ends of the first and second posts, respectively. Each proximal end of each of the first and second side bars further includes a downwardly and rearwardly extending portion which stops movement of the device when the walker device is pivoted back thereby positioning the downwardly rearward extending portions of the first and second side bars in a frictional engagement with the ground thus preventing the walker device from moving relative the ground. A means for directly restraining rotation of at least one of the plurality of wheels enables a person to walk, slow down or stop without the need for other assistance.

In another embodiment the plurality of wheels includes a caster wheel rotatably mounted at each distal end of the first and second side bars to further enable the wheeled walking device to be steerable in a horizontal plane. In a preferred embodiment the distal ends of the first and second side bars are downward concavely shaped with the castor wheels mounted at the terminal portion thereof to further maintain the ground engaging wheel against the ground as the device of the invention is being pushed in a forward direction.

In a further embodiment the second ends of the first and second posts are pivotally connected at the proximal end of each of the first and second side bars, respectively. This enables the carriage frame to fold between the first and second posts thereby permitting easy storage of the device. The preferred attachment of the post to the side bar is by an axle pin which pivotably interconnects the post to the side bar. The axle pin further includes a wheel rotatably attached thereto. In the most preferred embodiment, the axle pin rotatably interconnects the post relative the side bar and further includes a wheel rotatably attached thereto.

A locking means securely attaches the first and second posts to the first and second side bars, respectively, to prevent the carriage frame from folding or collapsing while the device is in use. Any means which prevents the first and second post from rotating relative the first and second side bar is considered to be within the scope of the invention.

In another embodiment a second crossbar securely attaches to the first ends of the first and second posts at a position adjacent the first crossbar to interconnect the first and second posts and to provide a hand grip for the user.

The wheeled walking device may further include a means for restraining rotation of at least one of the plurality of wheels by including a U-shaped member having a first and second arm and an linking rod. The linking rod of the U-shaped member is disposed in a parallel and spaced position relative the first crossbar. The first and second arms of the U-shaped member are pivotally attached at the first and second posts, respectively. First and second brake rods each include a first and second end with the first ends of the first and second brake rods being connected to the first and second arms, respectively. The first and second brake rods extend along the first and second posts to the periphery of the first and second wheels, respectively, whereby maneuvering the linking rod simultaneously forces the second ends of the first and second brake rods against the peripheries of the first and second wheels, respectively, thereby frictionally interfering with the rotation of the first and second wheels to stop the wheeled device.

The U-shaped member may extend forward or rearward relative the posts, which determines which direction the U-shaped member must be urged to initiate a wheel braking action where the brake rods are always connected rearward the pivot point of attachment. If the U-shaped member extends forward the posts, then the U-shaped member must be lifted upward to engage the second end of the brake rods against the wheels. Otherwise if the U-shaped member extends rearward the posts, the U-shaped member must be pushed downward to engage the second end of the brake rod against the wheels. Preferably, the first and second brake rods are biased in non-engaging position by a spring or the like.

The wheeled walking device of the invention may further include hand grips which extend rearward from the posts to further provide controlling and gripping means when needed by the user.

In a preferred embodiment of the invention the first and second posts mounted at each proximal end of the first and second side bars, respectively, extend upward in a slightly forward direction before bending to a vertically upward direction relative the carriage frame. This configuration applies the force pushing the walker device such that contact with the ground at the distal end of the first and second side bars is enhanced. The preferred angle bent in the first and second posts is about 20 degrees.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DISCUSSION

Figure 1:
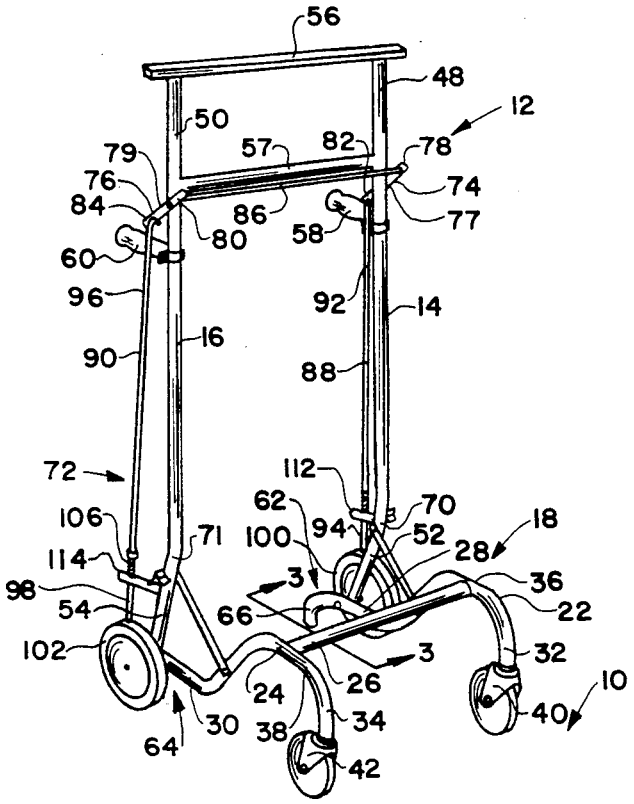
FIG. 1 is an isometric view of the device of the invention.

A wheeled walking apparatus, generally denoted as 12 in FIG. 1, is illustrated in the several Figures. FIG. 1 discloses a preferred embodiment of the wheeled walker 12 of this invention including a first post 14 and a second post 16 connecting to a carriage frame 18. The carriage frame 18 comprises a first side bar 22 and second side bar 24 which are interconnected by a transverse bar 26 in order to provide a torsionally rigid frame. The first side bar 22 and second side bar 24 further include proximal end 28 and 30 and distal ends 32 and 34, respectively. Each of the distal ends 32 and 34 of the first and second side bars 22 and 24 is concave downward at 36 and 38 with caster wheel 40,42 mounted at the terminal portion thereof, respectively.

The first post 14 and second post 16 further include first ends 48 and 50 and second ends 52 and 54, respectively. A first crossbar 56 is securely attached at the first ends 48 and 50 of the first and second posts 14 and 16. Second crossbar 57 is also securely attached between posts 14 and 16, spaced from first crossbar 56. The proximal ends 28 and 30 of the first and second side bars 22 and 24 respectively include extended portions 66 and 68 which extend rearward and downward relative the carriage frame 18. This enables the apparatus 12 to be tilted in a backward direction which causes the front casters 40 and 42 to lift off the ground generally denoted as 10 in FIG. 1 such that the downward extended portions 66 and 68 at the rear or proximal end of the side bars 22 and 24 frictionally engages the ground 10 to inhibit movement of the apparatus 12.

Each second end 52 and 54 of the first and second posts 14 and 16 further includes a bend 70 and 71 proximate the position where the first and second posts 14 and 16 is attached at the proximal ends 28 and 30 of the first and second side bars 22 and 24, respectively. The bends 70 and 71 are the result of the first and second posts 14 and 16 extending upwardly from the attachment points at the proximal ends 28 and 30 of the first and second side bars 22 and 24 a slightly forward direction before bending to a vertically upward direction relative the carriage frame 18. This configuration enhances the contact with the ground 10 of the distal end 32, 34 of the first 22 and second side bar 24 of the carriage frame 18.

Brake means generally denoted 72 in FIG. 1 for inhibiting rotation of at least one of a plurality of wheels is also within the scope of the invention. In a preferred embodiment, the brake means 72 comprises a first arm 74 and second arms 76. Each arm 74 and 76 includes a proximal end 78 and 80 a distal end 82 and 84 and an intermediate portion 77 and 79, respectively. The intermediate portions 77 and 79 of the first arm 74 and second arm 76, respectively, are pivotally attached near each first end 48 and 50 of the first and second posts 14 and 16.

A linking rod 86 interconnects the first arm 74 and the second arm 76 at their respective proximal ends 78 and 80. The linking rod 86 is disposed in a substantially parallel and spaced position relative the first and second crossbars 56 and 57. The linking rod 86 may be rigidly or pivotally secured to the proximal ends 78 and 80 of the first and second arms 74 and 76, respectively.

As shown in FIG. 1, a first brake rod 88 has a first end 92 and a second end 94, with the first end 92 of first brake rod 88 being connected to first arm 74 of brake means 72. First brake rod 88 extends along first post 14, terminating at second end 96 in the vicinity of the periphery of first wheel 100. A first brake rod guide means 112 directs first brake rod 88 into the periphery of first wheel 100. A first spring 104 (shown more clearly in FIG. 3) is coaxially received on first brake rod 88. Guide means 112 includes a first spring stop 116, as shown more clearly in FIG. 3. First brake rod 88 also includes a brake rod spring stop 108. Spring 104 is positioned between the first spring stop 116 on guide means 112 and the brake rod spring stop 108 such that the brake rod 88 is biased in a non-engaging relationship to wheel 100.

In a similar manner on the opposite side of the symmetrical device as shown in FIG. 1, a second brake rod 90 has a first end 96 and a second end 98, with the first end 96 of second brake rod 90 being connected to second arm 76 of brake means 72. Second brake rod 90 extends along second post 16, terminating at second end 98 in the vicinity of the periphery of second wheel 102. A second brake rod guide means 114 directs second brake rod 90 into the periphery of second wheel 102. A second spring 106 is coaxially received on second brake rod 90. Guide means 114 includes a second spring stop 116. Second brake rod 90 also includes a brake rod spring stop and spring 106 is positioned between the those two spring stops 116 on guide means 112 and the brake rod 90 such that the brake rod 90 is biased in a non-engaging relationship to wheel 102.

Figure 2:
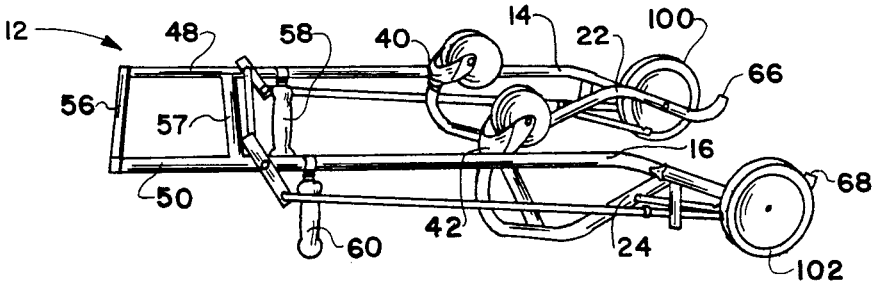
FIG. 2 is a view of the device of FIG. 1 in a collapsed position.
Figure 3:
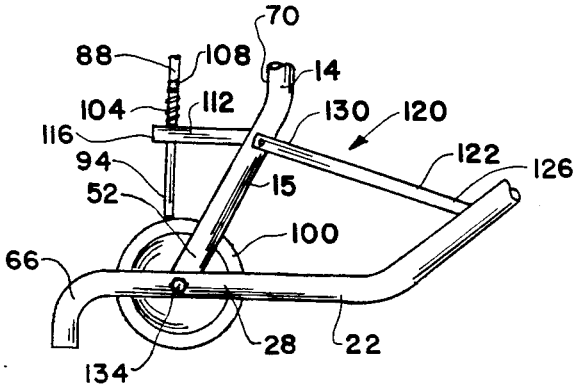
FIG. 3 is an enlargement taken along line 3—3 of FIG. 1.
Figure 5:
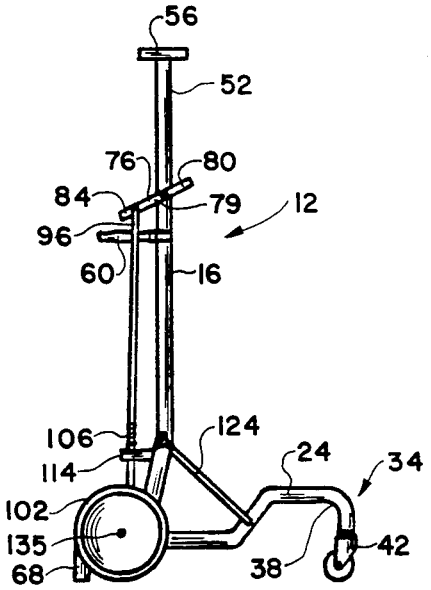
FIG. 5 is a side view of the device shown in FIG. 1.

FIG. 2 illustrates the apparatus 12 in a folded or collapsed position. The locking means generally denoted 120 in FIG. 3 interconnects the first side bar 22 with the first post 14 and the second side bar 24 with the second post 16 on opposite sides to prevent collapsing of the wheeled device. The locking means embraces a first elongated member 122 and a second elongated member 124 which include first ends 126 and 128 and second ends 130 and 132, respectively, as indicated in FIGS. 3 and 5. The first ends 126 and 128 of the elongated members are securely and rotatably attached to the respective proximal ends 28 and 30 of the first and second side bars 22 and 24. The second ends 130 and 132 of the elongated members 122 and 124 are removably attached to the second ends 52 and 54 of the first and second posts 14 and 16. The manner of attachment of the second ends 130 and 132 of the elongated members 122 and 124 to the second ends 52 and 54 of the first and second posts is 14 and 16 by a thumb screw, or the like, which inhibits removal of the elongated members 122 and 124 from the posts 14 and 16.

FIG. 3 is an enlargement taken along line 3—3 of FIG. 1 showing one half of the symmetrical rear portion of the carriage 18. FIG. 3 illustrates the attachment of wheel 100 to the carriage frame 18 by axle pin 134 which rotatably secures wheel 100 to the second end 52 of first post 14 and to the proximal end 28 of side bar 22. The axle pin 134 also permits side bar 22 of carriage frame 18 to pivot relative the second end 52 of first post 14 when the second end 130 of elongated member 122 is detached from the second end 52 of the first post 14 such that the folded or collapsed position of FIG. 2 is attained.

FIG. 3 also illustrates the ground engaging portion 66 of the first side bar 22 and bend 70 of the first post 14. The bend 70 is an angle of roughly 20 degrees in the preferred embodiment.

On opposite sides of the carriage 18, the preferred arrangement for attaching wheel 100 to side bar 22 and wheel 102 to side bar 24 of the apparatus of the invention includes axle pins 134 and 135 which secure wheels 100 and 102 to side bar 22 and 24 and to post 14 and 16, respectively.

Figure 4:
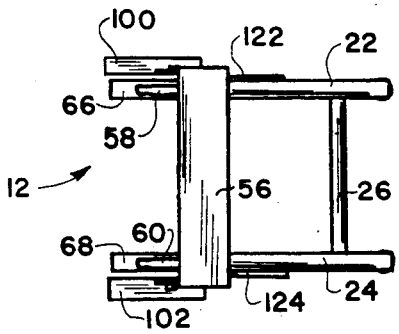
FIG. 4 is a top view of the device shown in FIG. 1.

FIG. 4 is a top view of the apparatus 12 set forth in FIG. 1 illustrating first crossbar 56 and transverse bar 26 which interconnects the wheeled side bar 22 and wheeled side bar 24.

FIG. 5 illustrates one side view of the symmetrical apparatus 12 of FIG. 1. The distal portion 34 of side bar 24 includes a downward concave portion 38 with the caster wheel 42 at the terminal portion thereof. The proximal end 30 (hidden behind wheel 102) of side bar 24 further includes a ground engaging portion 68 of the second side bar 24. A first crossbar 56 is positioned at the first end 52 of the second post 16 which provides an arm rest for the user. A hand grip 60 is disposed near the middle of second post 16.

Figure 6:
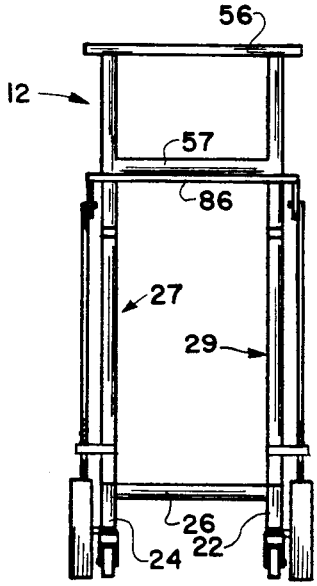
FIG. 6 is a front view of the device shown in FIG. 1.

FIG. 6 is a front view of the device 12 of FIG. 1 illustrating the first crossbar 56, second crossbar 57 and transverse bar 26 which interconnects first side bar 22 and second side bar 24 in a rigid manner. Linking rod 86 is positioned proximate second crossbar 57 to enable easy grasping of linking rod 86 to activate brake means 72 by pulling the linking rod 86 toward the second crossbar 57.

Figure 7:
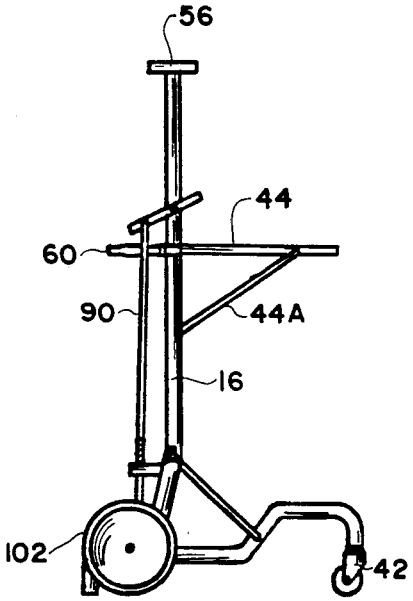
FIG. 7 is a side view of the assembled apparatus of the invention with a tray attached.

FIG. 7 is a side view of the apparatus of the invention 12 with a tray 44 removably attached by thumb screws, or the like, to the first post 14 (not shown) and second post 16. Tray support 44A adds strength and stability to tray 44. This attachment enables the user of the apparatus of the invention to go along a cafeteria line or the like and select or have selected desired items and place them on a tray with little or no assistance.

Figure 8:
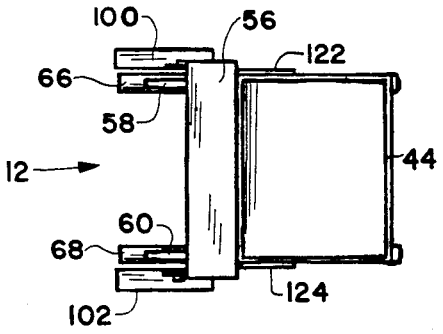
FIG. 8 is a top view of the device shown in FIG. 7.

FIG. 8 is a top view of the embodiment shown in FIG. 7 illustrating the tray 44 removably attached to the apparatus of the invention 12.

Figure 9:
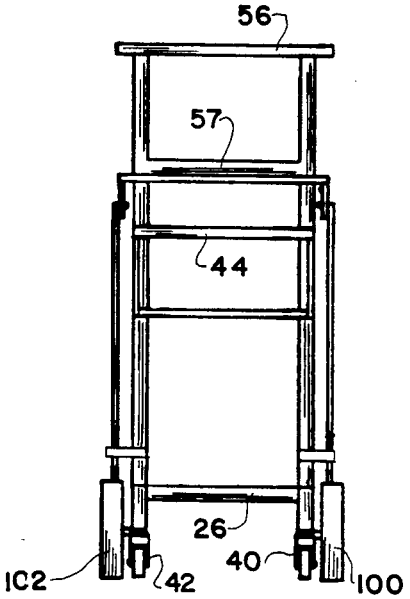
FIG. 9 is a front view of the device shown in FIG. 7.

FIG. 9 is a front view of the embodiment shown in FIG. 7 illustrating the relative posistions of casters 40 and 42 and wheels 100 and 102. Positioning casters 40 and 42 inside of the track of wheels 100 and 102 enhances the steerability of the apparatus.

Figure 10:
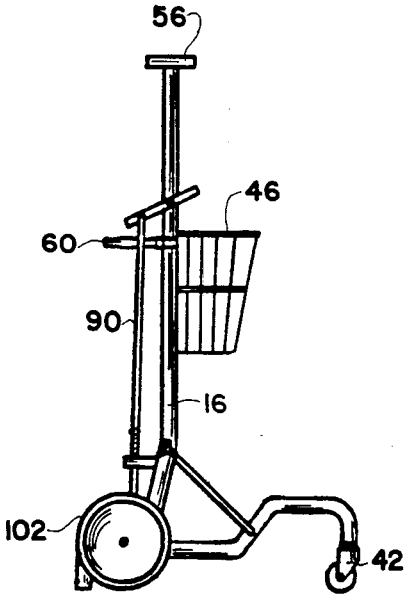
FIG. 10 is a side view of the assembled apparatus of the invention with a basket attached.

FIG. 10 is a side view of the assembled apparatus with a basket 46 removably attached to first post 14 (not shown) and second post 16 in the manner previously shown for attaching tray 44. This attachment enables the user to move about a supermarket, or the like, and collect items for purchase.

Figure 11:
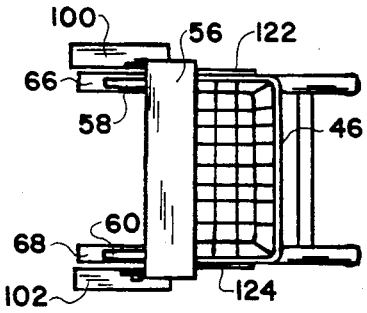
FIG. 11 is a top view of the device shown in FIG. 10.

FIG. 11 is a top view of the embodiment of FIG. 10 illustrating the basket 46.

Figure 12:
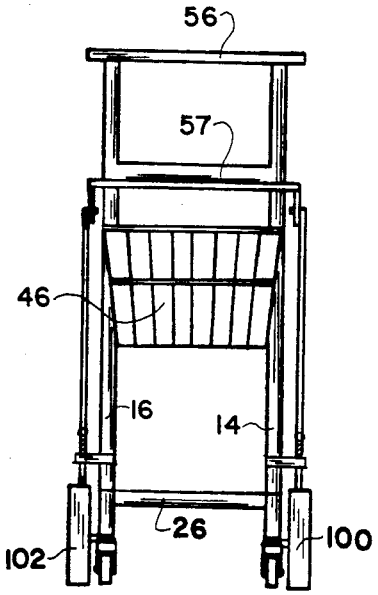
FIG. 12 is a front view of the device shown in FIG. 10.

FIG. 12 is a front view of the embodiment of FIG. 10.

In another embodiment of the invention the hand grips 58 and 60 may be secured at selected levels along first post 14 and second 16 post by, for example, the use of split rings secured by an attaching means, such as a screw.

In another embodiment of the invention, first post 14 and second post 16 may include a telescopic adjustment means to enable first crossbar 56 to be adjusted to different heights relative the ground.

Although the present invention has been described and illustrated with respect to specifically preferred features thereof, it is to be understood that various modifications may be made without departing from the scope of the present invention.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the construction and arrangements of parts may be resorted to without departing from the spirit and scope of the invention.

What is claimed:

1. A wheeled walking aid comprising:

a carriage frame having a first and a second side bar with a transverse bar interconnecting said first and second side bars in a torsionally rigid manner;

each said first and second side bars of said carriage frame having a proximal and a distal end;

a first and a second post with each said first and second posts including a first and a second end with each said second end of each said first and second posts being securably positioned at each said proximal end of each said first and second side bars, respectively, such that in use said first and second side bars do not present foot-entangling structure and said first and second posts extend substantially vertically relative to said carriage frame in a parallel and spaced manner;

a first crossbar securely attaching each said first end of said first and second post thereby interconnecting said first and second post and providing an arm rest surface;

a first and a second ground engaging wheel rotatably mounted at each said second end of each said first and second post, respectively;

each said first and second side bars further include a downwardly and rearwardly extending portion to impair rotation of the wheeled walking aid relative to said first and second ground engaging wheels when the walker device is pivoted back enabling said downwardly rearward extending portion of said first and second side bar to frictionally engage the ground thereby preventing the walker device from moving;

a third and a fourth ground engaging caster wheel rotatably mounted at each said distal end of said first and second side bars to enable the wheeled walking device to be steerable in a horizontal plane along the ground;

each said distal end of each said first and second side bars being downwardly concavely shaped with a terminal portion to enable said third and fourth rotatably mounted castor wheels to be mounted at each said terminal portion, respectively, to further maintain said ground engaging wheel against the ground;

each said first and second posts extending upwardly in a slightly forward direction before bending to a vertically upward direction relative to said carriage frame such that in use the force pushing the walker device enhances the contact with the ground of each said third and fourth castor wheels positioned at each said distal end of said first and second side bars, respectively; and means for directly restraining rotation of at least one of said ground engaging wheels to enable in use a person to walk, slow down or stop without the need for further assistance.

2. The wheeled walking device of claim 1 wherein each said second end of said first and second posts being pivotably connected at each said proximal end of each said first and second side bars respectively, to enable said carriage frame to fold between said first and second posts; and a locking means securely attaching each said first and second posts and to each said first and second side bars, respectively, to prevent said carriage frame from folding between said first and second posts.

3. The wheeled walking device of claim 1 further including a second crossbar securely attaching each said first end of each said first and second posts thereby interconnecting said first and second post and further providing a hand grip bar.

4. The wheeled walking device of claim 1 wherein said means for restraining rotation of at least one of said ground engaging wheels includes a U-shaped member having a first and second arm and an linking rod;

said U-shaped member being disposed in a parallel and in a spaced position relative to said first cross-bar;

said first and second arms being pivotally attached at each said first and second posts, respectively;

a first and a second brake rod with each said first and second rod having a first and a second end;

each said first end of each said first and second brake rods being connected to each said first and second arm, respectively;

said first and second brake rods extend along said first and second post respectively and terminate at a position proximate a periphery of each said first and second wheel, respectively, whereby manipulating said linking rod simultaneously engages each said second end of each said first and second brake rods against said periphery of said first and second wheels, respectively, thereby interfering with the rotation of said first and second wheels.

5. The wheeled walking device of claim 4 wherein said first and second brake rods are biased in an non-wheel engaging position.

6. The wheeled walking device of claim 1 wherein each said first and second posts includes hand grips extending rearwardly from each of said first and second posts.

7. The wheeled walking device of claim 1 wherein said first and second posts which extend upward in a slightly forward direction bend to a vertically upward direction at an angle of about 20 degrees relative to the carriage frame.

* * * * *